US008272542B2

(12) United States Patent
Becker

(10) Patent No.: US 8,272,542 B2
(45) Date of Patent: Sep. 25, 2012

(54) SPRAY CAN HANDLE ATTACHMENT

(75) Inventor: Kenneth Jay Becker, Talent, OR (US)

(73) Assignee: SafeWorld International Inc., Ashland, OR (US)

( * ) Notice: Subject to any disclaimer, the term of this patent is extended or adjusted under 35 U.S.C. 154(b) by 618 days.

(21) Appl. No.: 12/394,680

(22) Filed: Feb. 27, 2009

(65) Prior Publication Data

US 2010/0051652 A1 Mar. 4, 2010

Related U.S. Application Data

(60) Provisional application No. 61/032,444, filed on Feb. 29, 2008.

(51) Int. Cl.
*B65D 83/00* (2006.01)
*B65D 83/16* (2006.01)

(52) U.S. Cl. ..... 222/402.13; 222/402.15; 222/323; 222/473; 40/642.01; 40/642.02

(58) Field of Classification Search ..... 222/402.13, 222/402.15, 323, 473, 180, 181.1, 181.2, 222/181.3; 40/642.01, 642.02, 124.06, 661.03, 40/661.12, 673, 674
See application file for complete search history.

(56) References Cited

U.S. PATENT DOCUMENTS

| | | | | |
|---|---|---|---|---|
| 1,757,530 | A * | 5/1930 | Keim | 239/57 |
| 1,970,631 | A * | 8/1934 | Sherman | 222/498 |
| 2,720,422 | A | 10/1954 | Mercur | |
| 2,887,272 | A | 9/1955 | Rosenthal | |
| 2,803,383 | A | 8/1957 | Dickman et al. | |
| 2,820,578 | A * | 1/1958 | Dickman | 222/323 |
| 2,830,742 | A * | 4/1958 | Gibbons et al. | 222/323 |
| 3,007,613 | A | 7/1958 | Tygard | |
| 2,868,421 | A * | 1/1959 | Schott | 222/473 |
| 3,045,878 | A | 2/1959 | Blanford et al. | |
| 2,877,934 | A * | 3/1959 | Wallace | 222/323 |
| 2,884,166 | A | 4/1959 | Vosbikian et al. | |
| 2,941,700 | A * | 6/1960 | Gable | 222/402.15 |
| D189,323 | S | 11/1960 | Epstein | |
| 2,960,260 | A * | 11/1960 | Kutik | 222/473 |
| 3,109,565 | A | 11/1963 | Kutik | |

(Continued)

FOREIGN PATENT DOCUMENTS

GB 2038952 A * 7/1980

(Continued)

*Primary Examiner* — Kevin P Shaver
*Assistant Examiner* — Nicholas Weiss
(74) *Attorney, Agent, or Firm* — Hartman Global IP Law; Gary M. Hartman; Domenica N.S. Hartman

(57) ABSTRACT

A handle attachment for mounting to a standardized valve mounting cup of a spray can and operating a push-type dispenser valve. The handle attachment includes a housing that defines a grip and a cap configured to couple with an outer diameter of the valve mounting cup. An actuation device is pivotally mounted to the housing and includes a trigger portion disposed adjacent the grip and a finger portion disposed within the cap for actuating the push-type dispenser valve. A C-shaped rim is disposed on the cap and defines a central opening sized to accommodate the valve mounting cup, a base located on the axis of symmetry of the rim, a circumferential gap located on the axis of symmetry diametrically opposite the base and separating two ends of the rim, and at least one slot disposed between the base and a diametrical chord perpendicular to the axis of symmetry.

14 Claims, 5 Drawing Sheets

U.S. PATENT DOCUMENTS 3,112,849 A * 12/1963 Wallace ..... 222/323
3,138,331 A 6/1964 Kutik
3,146,916 A 9/1964 Kronheim
3,154,811 A * 11/1964 Gardener ..... 425/376.1
3,159,319 A * 12/1964 Parish ..... 222/402.13
3,182,337 A 5/1965 Price
3,189,232 A * 6/1965 Joffe ..... 222/402.13
3,240,384 A * 3/1966 Lermer ..... 220/780
D206,970 S 2/1967 Matthews
3,304,797 A 2/1967 Graveley
3,314,577 A 4/1967 Doblin
3,318,493 A 5/1967 Belpedio
3,414,161 A * 12/1968 Doring ..... 221/2
3,429,484 A * 2/1969 Baldwin ..... 222/402.13
3,433,351 A * 3/1969 Zaborney ..... 206/533
3,441,178 A * 4/1969 Dgetluck ..... 222/105
3,478,938 A 11/1969 Krause
3,501,066 A * 3/1970 Andreoli ..... 222/402.13
3,506,159 A * 4/1970 Muller ..... 222/135
3,510,028 A 5/1970 Batistelli
3,580,432 A 5/1971 Brooks
3,611,820 A 10/1971 Hempel
3,613,958 A * 10/1971 Opp ..... 222/180
3,659,791 A 5/1972 Clark
3,734,357 A * 5/1973 Batistelli et al. ..... 222/323
3,744,921 A * 7/1973 Weller et al. ..... 401/2
3,773,227 A * 11/1973 Laing et al. ..... 222/153.1
3,863,814 A * 2/1975 Shelton ..... 222/153.1
3,934,751 A * 1/1976 Green et al. ..... 220/784
3,967,763 A 7/1976 Focht
3,987,942 A 10/1976 Morane et al.
4,040,543 A 8/1977 Guillen
4,089,440 A 5/1978 Lee
4,092,000 A 5/1978 Offutt, III
4,098,436 A 7/1978 Kohlbeck
4,248,360 A 2/1981 Crump
4,258,857 A * 3/1981 McGee ..... 220/212
4,326,649 A * 4/1982 Marino et al. ..... 222/182
4,401,240 A 8/1983 Brack
4,432,474 A * 2/1984 Hutchinson et al. ..... 222/402.15
4,534,481 A * 8/1985 Summers et al. ..... 215/253
4,579,258 A 4/1986 Brown et al.
D287,394 S * 12/1986 Yamamoto ..... D23/225
4,660,745 A * 4/1987 Hess, Jr. ..... 222/174
D294,226 S 2/1988 Smith
4,789,084 A 12/1988 Yoshitomi
4,805,812 A * 2/1989 Brody ..... 222/402.11
4,971,257 A 11/1990 Birge
5,018,647 A 5/1991 Abplanalf
5,027,986 A 7/1991 Heinzel et al.
5,040,703 A * 8/1991 Roark et al. ..... 222/173
5,086,954 A * 2/1992 Brody ..... 222/402.11
5,203,478 A 4/1993 Laforcade et al.
5,310,096 A * 5/1994 Rogers et al. ..... 222/402.13
5,323,937 A * 6/1994 Brody ..... 222/402.11
5,492,675 A * 2/1996 Brizard ..... 422/122
5,540,359 A 7/1996 Gobbel
5,549,226 A 8/1996 Kopp
5,597,095 A 1/1997 Ferrara, Jr.
5,716,008 A * 2/1998 Nottingham et al. ..... 239/333
5,752,630 A * 5/1998 Guo ..... 222/192
5,762,217 A * 6/1998 Ohmi et al. ..... 215/253
5,769,272 A * 6/1998 Massena ..... 222/1
5,819,984 A * 10/1998 Krueger ..... 222/181.2
5,819,985 A * 10/1998 Brody ..... 222/153.09
5,904,273 A 5/1999 Aspacher et al.
5,908,125 A * 6/1999 Opresco ..... 215/216
5,930,925 A * 8/1999 Gringer ..... 40/314
5,992,707 A * 11/1999 Gaichuk ..... 222/402.13
5,992,708 A 11/1999 Gaichuk
6,029,862 A * 2/2000 Jones ..... 222/402.11
D421,909 S * 3/2000 Opresco ..... D9/443
6,102,269 A * 8/2000 Elliott et al. ..... 226/130
6,173,870 B1 1/2001 Taylor
6,189,178 B1 * 2/2001 Roberts ..... 15/323
6,206,322 B1 * 3/2001 Elliott et al. ..... 242/564.2
6,299,032 B1 10/2001 Hamilton
6,390,333 B1 5/2002 Bozzo
6,637,627 B1 * 10/2003 Liljeqvist et al. ..... 222/402.15
6,705,494 B2 3/2004 Thompson et al.
6,896,192 B2 5/2005 Horan et al.
6,981,622 B2 * 1/2006 Brody ..... 222/402.15
7,121,434 B1 10/2006 Caruso
7,121,435 B2 * 10/2006 Brody ..... 222/402.15
7,204,393 B2 4/2007 Strand
7,216,784 B2 * 5/2007 Brody ..... 222/402.15
7,252,210 B1 8/2007 Schultz et al.
7,316,334 B1 * 1/2008 Brody et al. ..... 222/402.15
7,743,950 B2 * 6/2010 Tsai ..... 222/323
7,753,237 B2 * 7/2010 Tsai ..... 222/323
8,052,015 B2 * 11/2011 Huang ..... 222/402.15
2001/0035466 A1 * 11/2001 Vazquez ..... 239/288
2002/0100767 A1 * 8/2002 Mellon ..... 222/1
2003/0218029 A1 * 11/2003 Brody ..... 222/402.15
2004/0028458 A1 * 2/2004 Heathcock et al. ..... 401/190
2004/0195271 A1 * 10/2004 Chen ..... 222/380
2005/0029311 A1 * 2/2005 Bostick ..... 222/402.15
2005/0218163 A1 * 10/2005 Mineau et al. ..... 222/402.1
2006/0071036 A1 4/2006 Gervais
2006/0076367 A1 * 4/2006 Brody ..... 222/402.15
2006/0255077 A1 11/2006 Sugano et al.
2007/0062980 A1 3/2007 Bates et al.
2007/0084884 A1 * 4/2007 Brody ..... 222/402.15
2007/0170205 A1 7/2007 Walker et al.
2007/0181610 A1 8/2007 Fazekas et al.
2008/0017673 A1 * 1/2008 Copps ..... 222/402.15
2008/0017674 A1 * 1/2008 Tsai ..... 222/402.15
2008/0054025 A1 * 3/2008 Tsai ..... 222/402.15

FOREIGN PATENT DOCUMENTS

GB 2190709 A * 11/1987
GB 2218471 A * 11/1989

* cited by examiner

SPRAY CAN HANDLE ATTACHMENT

CROSS REFERENCE TO RELATED APPLICATIONS

This application claims the benefit of U.S. Provisional Application No. 61/032,444, filed Feb. 29, 2008, the contents of which are incorporated herein by reference.

BACKGROUND OF THE INVENTION

The present invention generally relates to attachments capable of being mounted on an aerosol spray can to provide a secure handle and operate push-type dispenser valve of the spray can.

Various spray can attachments are known that provide a convenient grip and actuate a push-type dispenser valve to dispense the contents of a spray can. One such approach involves an attachment feature capable of coupling to an industry-standardized valve mounting cup of a conventional spray can. To do so, the attachment must be compatible with the nominal standardized dimensions of a valve mounting cup, including an outer diameter of about 1.270 to about 1.280 inches (about 3.23 to about 3.25 cm) and an outer rim thickness (in the axial direction) of about 0.120 inch to about 0.145 inch (about 3.05 to about 3.68 mm).

An existing spray can attachment is disclosed in U.S. Pat. No. 4,432,474, a commercial embodiment of which is known as the "CAN-GUN." The contents of this patent are incorporated herein by reference. The attachment method of the CAN-GUN involves two attachment features that resiliently snap into an annular channel defined by the inner perimeter of a standard valve mounting cup. The CAN-GUN includes an integral shield and a pistol grip. The grip, including the part defining the attachment features, can be formed of reprocessed or virgin copolymer in a one-shot mold process. The CAN-GUN further includes a trigger that when squeezed operates the dispenser valve by pressing downwardly on the top of the valve. A key aspect of the CAN-GUN is that it is easier to operate the valve with the trigger than to press and maintain pressure on the valve with a finger. Any competitive product of the CAN-GUN would preferably retain these advantages, as well as be easily and securely attachable to the valve mounting cup.

BRIEF DESCRIPTION OF THE INVENTION

The present invention provides a handle attachment capable of being mounted to a standardized valve mounting cup of a conventional aerosol spray can, and specifically to the exterior of the valve mounting cup by means of a resilient compression or capture feature, to provide a secure handle and enable the operation of a push-type dispenser valve of the spray can.

The handle attachment includes a housing that defines a grip and a cap configured to couple with an outer diameter of the valve mounting cup. An actuation device is pivotally mounted to the housing, and is configured to comprise a trigger portion disposed adjacent the grip and a finger portion disposed within the cap for actuating the push-type dispenser valve of the spray can in response to movement of the trigger portion relative to the grip of the housing. A C-shaped rim is disposed on the cap and configured to have an axis of symmetry and define a central opening sized to accommodate the valve mounting cup. The C-shaped rim further comprises a base located on the axis of symmetry, a circumferential gap located on the axis of symmetry diametrically opposite the base and separating two ends of the C-shaped rim, and at least one slot disposed between the base and a diametrical chord perpendicular to the axis of symmetry.

According to preferred aspects of the invention, the handle attachment can be readily installed on a spray can with an amount of effort within the capability of a person with limited strength and dexterity. While remaining securely attached to the valve mounting cup of the spray can during use, the handle attachment reduces the amount of effort required to continuously operate a push-type disperse valve of a spray can.

Other aspects and advantages of this invention will be better appreciated from the following detailed description.

DETAILED DESCRIPTION OF THE INVENTION

Figure 1:
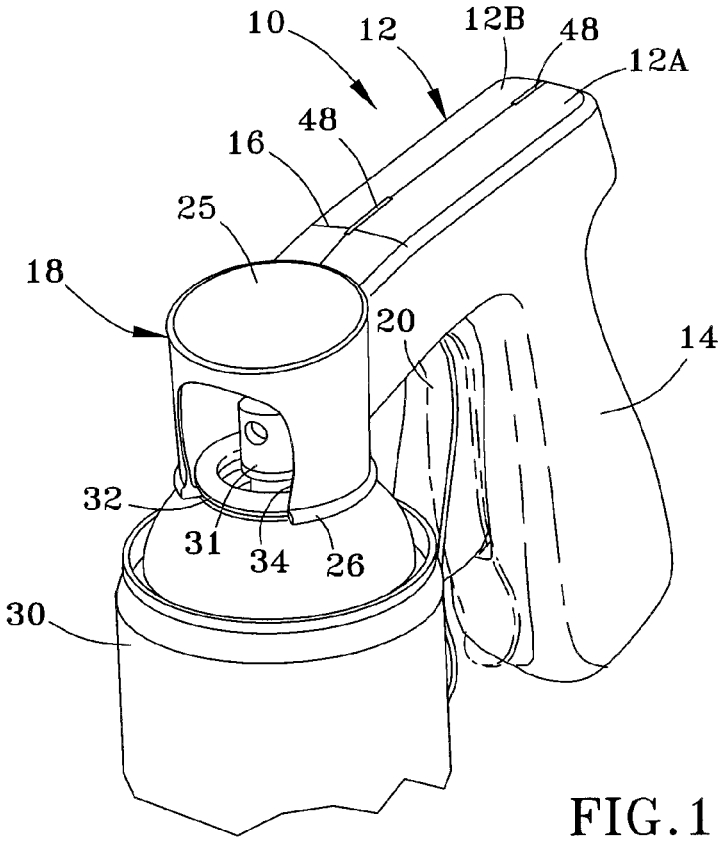
FIG. 1 is a perspective view of a spray can handle attachment in accordance with a preferred embodiment and attached to a valve mounting cup of a conventional aerosol spray can.
Figure 12:
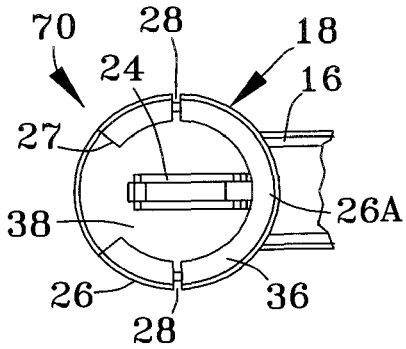
Figure 13:
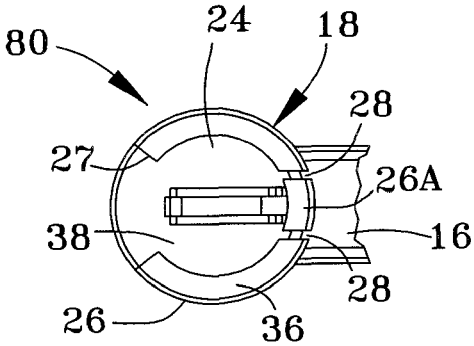
Figure 14:
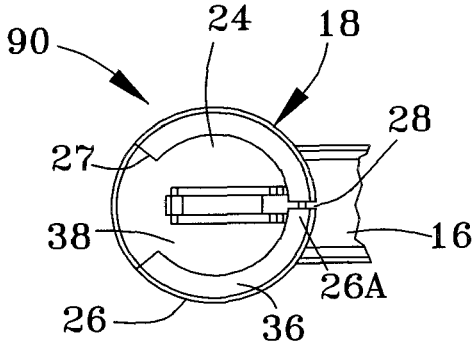

FIGS. 1 through 11 represent a spray can handle attachment 10 in accordance with what is believed to be a preferred embodiment of the invention. Additional embodiments are represented in FIGS. 12, 13 and 14. In the drawings, identical reference numerals denote the same or equivalent elements throughout the various views. For convenience, the attachment 10 will be described as having a front, rear, top, bottom, and righthand and lefthand sides corresponding to the orientation of the attachment 10 relative to the user when installed on a conventional aerosol spray can 30, as depicted in FIG. 1. Other than serving as points of reference, these descriptions should not be interpreted as limitations to the invention.

The attachment 10 can be seen in FIGS. 1 through 10 as comprising a two-piece housing 12 with housing halves 12A and 12B that can be separately formed by injection molding or some other suitable process. The housing 12 defines a grip 14, a neck 16, and a cylindrical-shaped coupling cap 18. The attachment 10 is further shown as equipped with a four-finger trigger 20 configured to pivot on a pivot 22 (FIG. 3) within the housing 12. The trigger 20 is part of an arm 21 that terminates with a finger 24 that protrudes into the coupling cap 18 and moves in a roughly axial direction of the coupling cap 18 when the trigger 20 is actuated relative to the attachment grip 14. The trigger arm 21 is biased with an integral cantilevered spring 23 that causes the trigger 20 to be biased away from the grip 14 and causes the finger 24 to be biased upward within the cap 18 and away from a push-type dispenser valve 31 of the spray can 30, as depicted in FIG. 1.

Figure 2:
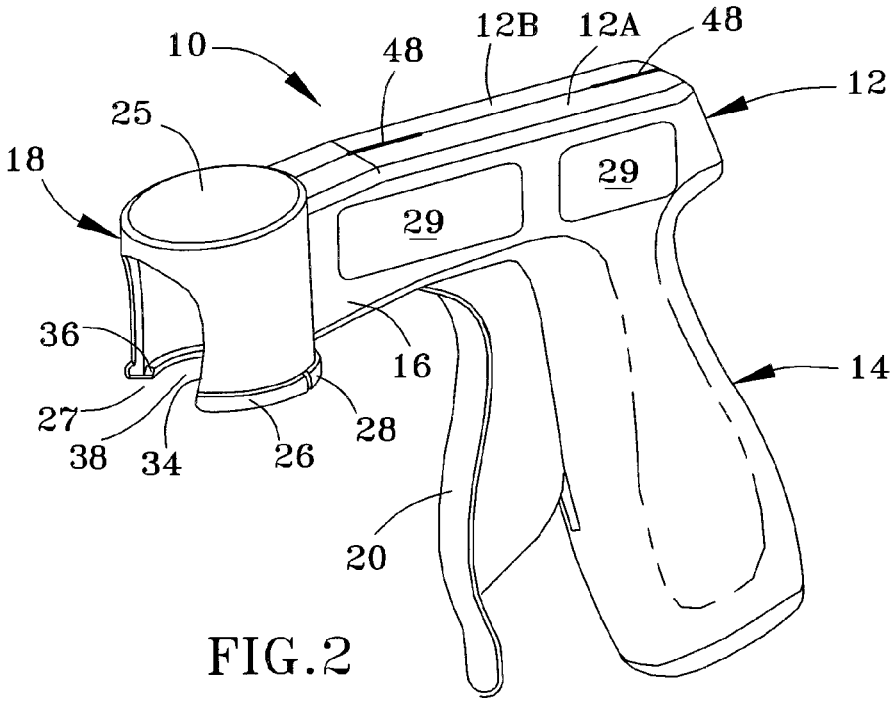
FIG. 2 is a perspective view of the spray can handle attachment of FIG. 1 removed from the spray can.
Figure 8:
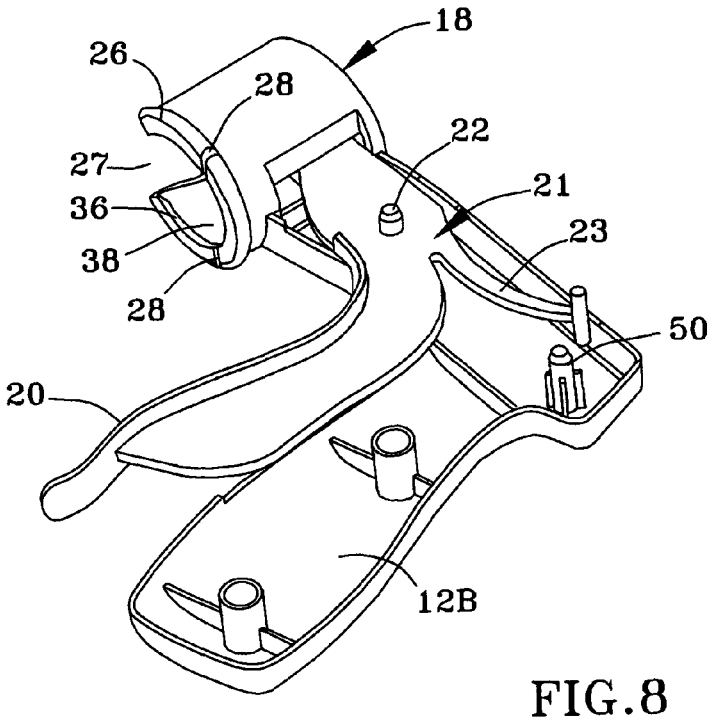
FIG. 8 is a perspective view of the spray can handle attachment of FIGS. 1 through 7 with a lefthand panel removed to expose interior components of attachment.
Figure 9:
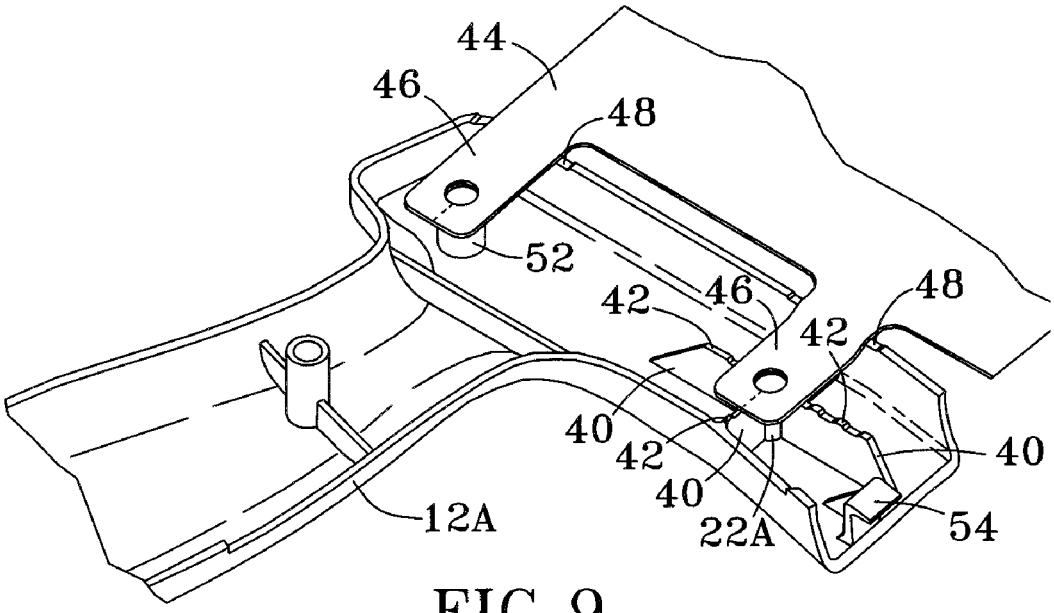
FIG. 9 is a perspective view of the handle attachment of FIGS. 1 through 8 with a righthand panel of the attachment removed to illustrate the manner in which a display card can be temporarily secured to the attachment.

The coupling cap 18 is represented in FIG. 8 as integrally molded with the righthand housing half 12B, and FIG. 9 shows a clip feature 54 for securing the lefthand housing half 12A to the cap 18. Alternatively, it is foreseeable that the cap 18 could be integrally molded with the lefthand housing half 12A or formed entirely separate from the housing halves 12A and 12B and subsequently assembled to the remainder of the housing 12. The cap 18 has a closed upper end and an open lower end defined by a rim 26. The closed upper end can be integrally molded with the remainder of the cap 18, though to facilitate fabrication by injection molding the upper end is preferably closed by a separately molded panel 25. This panel 25 provides a convenient location for labels or any other suitable type of indicia for the attachment 10. Similarly, FIG. 2 depicts the neck 16 and upper end of the grip 14 as provided with areas 29 for the attachment of labels or other indicia. The rim 26 of the cap 18 has a C-shaped configuration and includes a pair of slots 28 that in combination enable the cap 18 to snap onto and grip the outer circumference of a valve mounting cup 32 of the spray can 30, as depicted in FIG. 1. As will be explained in further detail, the rim 26 and its slots 28 provide a resilient compression or capture feature that enables the attachment 10 to be readily snapped onto the valve mounting cup 32 and thereafter remain secured during use of the attachment 10 to dispense the contents of the can 30.

Figure 3:
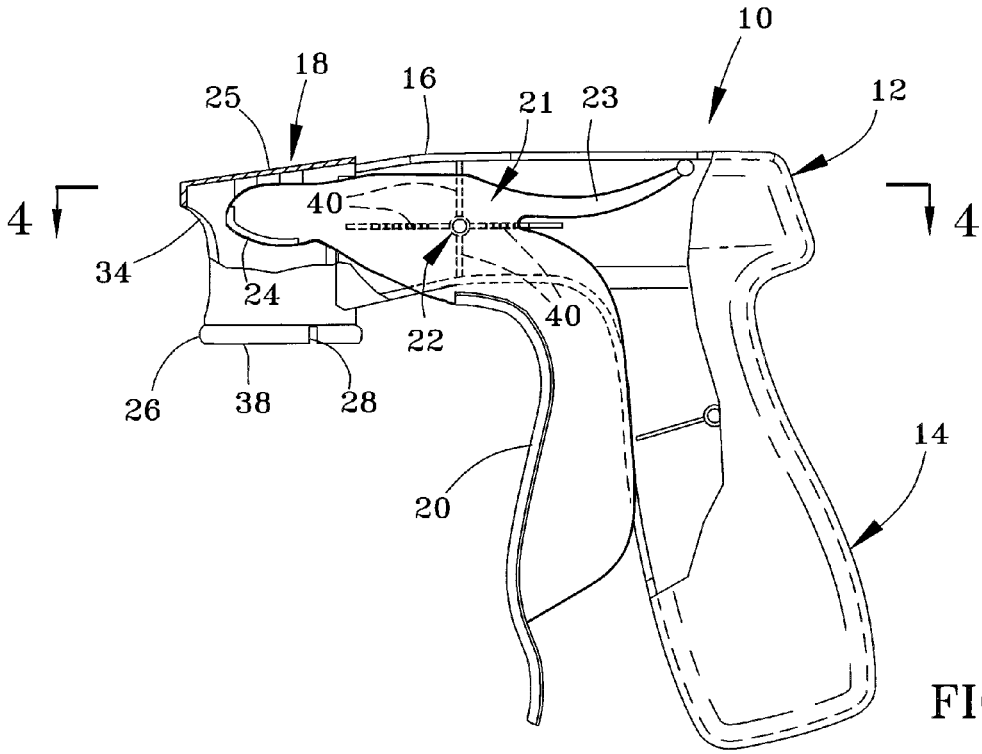
FIGS. 3 through 7 are side, top, bottom, front, and rear views, respectively, of the handle attachment of FIGS. 1 and 2.
Figure 4:
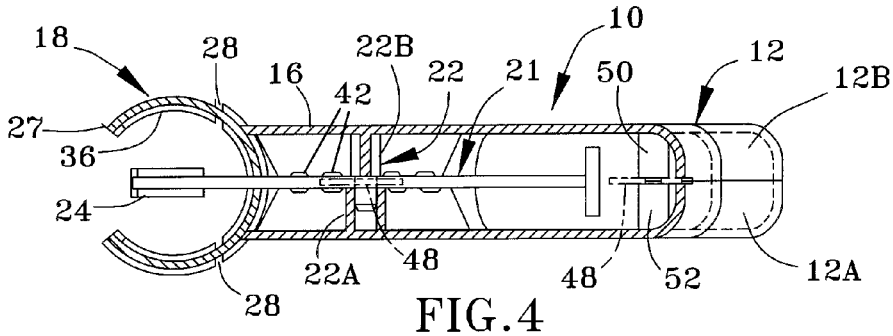
Figure 5:
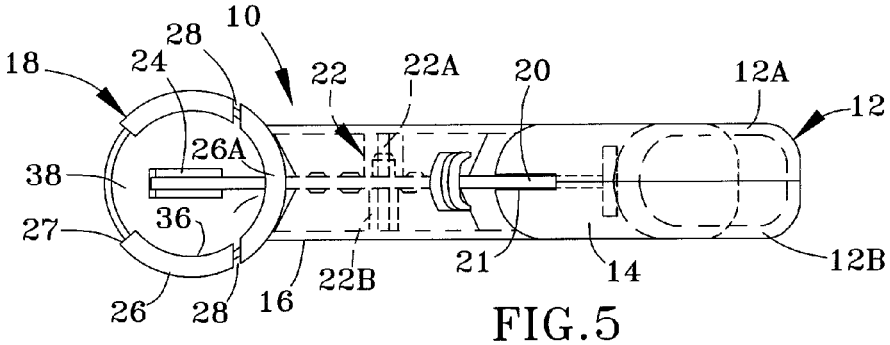
Figure 6:
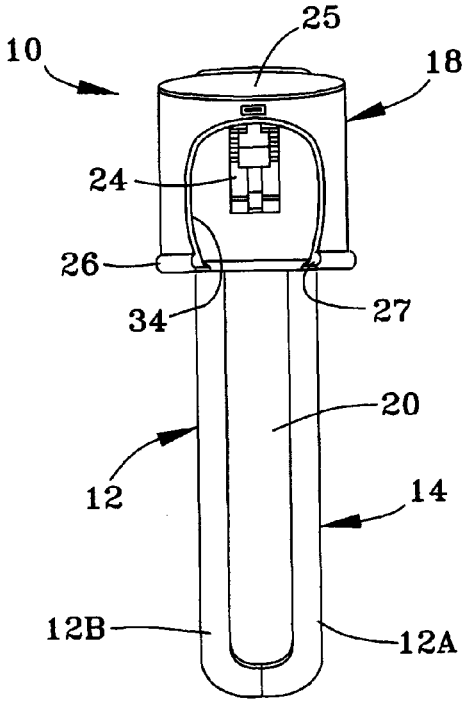
Figure 7:
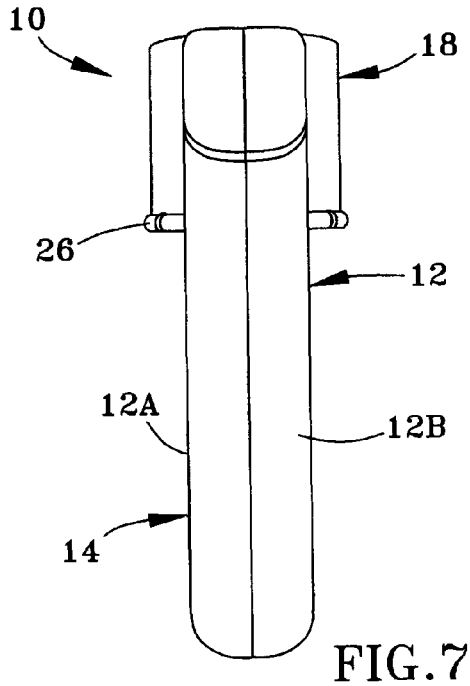
Figure 10:
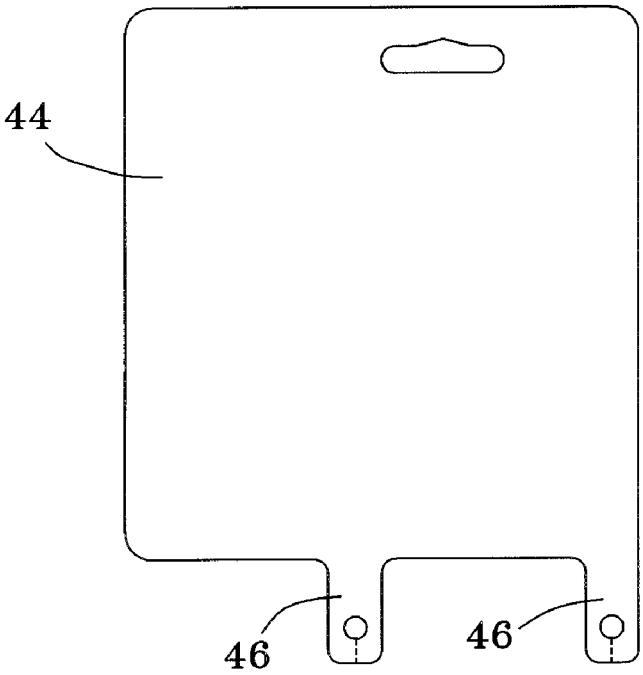
FIG. 10 is a plan view of the display card of FIG. 9.
Figure 11:
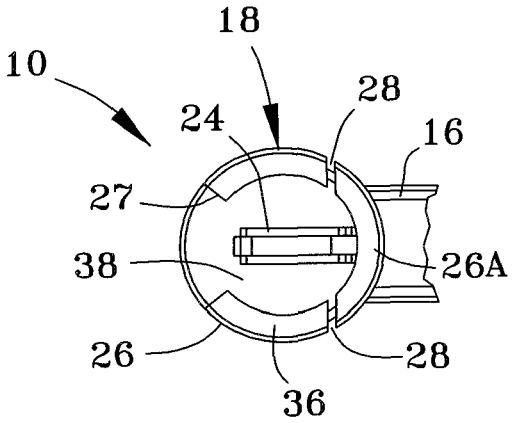
FIG. 11 is a detailed bottom view of a C-shaped attachment feature of the embodiment of FIGS. 1 through 10, and FIGS. 12, 13 and 14 depict alternative embodiments of C-shaped attachment features in accordance with alternative embodiments of the invention.

The preferred configuration for the rim 26 and the preferred configuration and orientation of its slots 28 is most readily apparent in FIGS. 3, 5 and 11. As viewed from the bottom (FIGS. 5 and 11), the C-shaped configuration of the rim 26 defines a circumferential gap 27 contiguous with a window 34 formed at the front of the cap 18 that extends through the rim 26. As evident from FIG. 1, this window 34 provides an aperture through which the contents of the spray can 30 are dispensed through the cap 18. As evident from the Figures, the window 34 is shaped to be wider above the rim 26 to accommodate a wide variety of spray patterns without the spray impinging the cap 18. With the exception of the circumferential gap 27, the rim 26 has a flange 36 that extends radially inward around a central circular opening 38 sized to provide an interference fit with the valve mounting cup 32 of the can 30. The circumferential gap 27 is roughly bisected by the axis of symmetry of the C-shaped rim 26 and accounts for approximately ninety degrees of the circumference of the rim 26, with lesser and greater angular extents being foreseeable. The slots 28 are circumferentially located approximately ninety degrees from each other and from the circumferential gap 27, and pass entirely through the flange 36 of the rim 26. In combination, the gap 27 and slots 28 formed in the rim 26 provide a degree of resilient expansion that enables the central opening 38 of the rim 26 to accommodate the diameter and thickness at the exterior perimeter of the valve mounting cup 32 of the spray can 30. As a nonlimiting example, with the cap 18 formed of a plastic material, for example, polypropylene copolymer, the diameter of the opening 38 can be about 1.150 to about 1.170 inches (about 2.9 to about 3.0 cm) to accommodate a standard cup 32 with an outer diameter of about 1.270 inches (about 3.2 cm), and the flange 36 can have an axial thickness of about 0.070 inch (about 1.8 mm) to accommodate a standard cup 32 with an outer rim thickness of about 0.120 inch (about 3.1 mm). In combination with slots 28 (for example, slots 28 having widths of up to about 0.1 inch (about 2.5 mm) or possibly larger), the gap 27 between the ends of the C-shaped rim 26 allows the rim 26 to expand and snap onto the exterior of the valve mounting cup 32. As discussed below, the cap 18 configured with the C-shaped rim 26 and the slots 28 located and oriented as shown in FIGS. 1 through 11 was found to be both readily securable to a valve mounting cup 32 without the need for excessive force, yet reliably retained on the cup 32 during use of the attachment 10 to dispense the contents of an aerosol can 30.

The preferred slots 28 shown in FIGS. 3, 5 and 11 are oriented to be roughly collinear with each other, perpendicular to the axis of symmetry of the rim 26, and lying on a nondiametrical chord located roughly midway between the base 26A (FIG. 5) of the rim 26 (diametrically opposite the gap 27) and a diametrical chord perpendicular to the rim's axis of symmetry. As such, each slot 28 is closer to the base 26A of the C-shape of the rim 26 than to the ends of the rim 26 separated by the rim gap 27 In the absence of the slots 28, a prototype spray can handle attachment formed of polymeric material and otherwise essentially identical to that shown in the Figures was found to be difficult to attach to a standard-sized valve mounting cup, though once mounted the attachment was very secure and resisted unintentional removal from the can. However, in order for the attachment 10 of this invention to be suitable for use by individuals with limited hand dexterity and strength, a lower installation force was desired while substantially retaining the capability of the attachment 10 to remain secured to the can 30 during use.

During additional investigations leading up to this invention, additional prototypes were fabricated from a polymeric material to have C-shaped rims with flanges generally similar to that of FIGS. 1 through 7, but with slots having different locations and orientations. In each case, the slot(s) passed entirely through the flange of the rim. FIG. 12 depicts the rim 26 of a prototype attachment 70 as having two collinear slots 28 lying on a diametrical chord of the rim 26 oriented roughly perpendicular to the rim's axis of symmetry. Though the slots 28 were determined to enable the C-shaped rim 26 to be readily installed on a standardized valve mounting cup of a spray can, the ends of the C-shaped rim 26 were relatively weak such that the attachment 70 was not able to be securely retained on the valve mounting cup.

Additional prototypes were then produced in which slots were formed closer to the base of the C-shape of the rim 26, with the intent that doing so might permit both expansion and contraction of the rim without excessively weakening the rim 26 adjacent the rim gap 27. In addition to prototypes configured as shown in FIG. 11, FIG. 13 represents the rim 26 of another group of prototypes 80 having two slots 28 that are parallel to each other and to the diametrical chord of the rim 26 lying on the rim's axis of symmetry, and are as close to and preferably closer to the rim's axis of symmetry than the ends of the rim 26 separated by the rim gap 27. FIG. 14 represents the rim 26 of another prototype 90 having a single slot 28 lying on the rim's axis of symmetry. The embodiments of FIGS. 11, 13 and 14 were observed to maintain a gripping strength similar to that generated by the ends of an unslotted C-shaped rim, while enabling the coupling cap 18 to be more easily attached and removed as compared to the unslotted C-shaped rim. A prototype attachment with a C-shaped rim having a single slot located on the diametrical chord of the rim lying on the rim's axis of symmetry was also prepared and evaluated, with similar results.

From these investigations, the placement of the slots 28 relative to the ends of a C-shaped rim 26 was experimentally shown to have a direct and significant effect on the ease or difficulty with which the coupling cap 18 can be attached to the valve mounting cup 32 of an aerosol can 30, as well as the strength with which the cap 18 is able to grip the valve mounting cup 32. However, it was also concluded that such attributes must be appropriately balanced to ensure that the rim 26 can be attached without excessive difficult, but then remain securely attached during use of the can 30. The embodiment of FIG. 11 was believed to achieve these desired goals: (1) compliant enough to expand around the outside of the valve mounting cup 32 of an aerosol spray can 30 without requiring an undue amount of force by the user to install and remove the handle attachment 10 from the can's valve mounting cup 32, and (2) robust enough to be able to firmly snap back into place from its expanded position to grip the valve mounting cup 32 firmly so that the rim 26 does not readily decouple from the can 30 and then continues to grip the cup 32 indefinitely without negatively affecting the integrity of the attachment mechanism. With regard to what might be deemed "undue force," a target of less than 10 lbf (about 44 N) of attachment/removal force was chosen to enable those with arthritis and many other users with reduced hand and arm/shoulder strength (e.g., over 65 years of age) to be able to easily utilize the spray can handle attachment.

To quantify the effect that the number, orientation, and width of slots 28 might have on a C-shaped rim 26 of the type shown in FIGS. 11, 13 and 14, the specific modifications set forth in Table I below were performed and their effects measured on the attachment/removal force using an UltraShip Ultra 75 electronic scale (accuracy +/−0.1 oz.) under ambient room temperature conditions. The spray handle attachment used and modified in the investigation was a commercial product known as SPRAY BOY, manufactured by IHF Plastics, Mietingen, Germany, whose attachment feature is a C-shaped clip. A long-handled version of the SPRAY BOY was employed for all but one test sample, identified in Table I as a "short-handled" version. Regarding slot placement, twelve o'clock lies on a radius on the axis of symmetry and centered within the gap of the C-shaped rim, parallel refers to slots oriented parallel to the axis of symmetry, and perpendicular refers to slots oriented perpendicular to the axis of symmetry.

Samples were tested by placing the bottom end of the Spray Boy handle against the center of the scale platform with minimal hand support of the spray handle and with the majority of the downward pressure on the spray can valve mounting cup/shoulder.

TABLE I

| # of Slots | Slot Orientation and Location(s) | Slot Width(s) (inch) | Avg. Force Req'd (lbf) |
|---|---|---|---|
| 0 | None | None | 13.5 |
| 0[a] | None | None | 10.75 |
| 1 | Parallel @ 6 o'clock | 0.090 | 9 |
| 1 | Parallel @ 4 o'clock | 0.045 | 8.5 |
| 2 | Parallel @ 5:30 and 6:30 o'clock | 0.045 | 8.5 |
| 2 | Parallel @ 5:30 and 6:30 o'clock | 0.090 | 6.75 |
| 2 | Perpendicular @ 4:30 and 7:30 o'clock | 0.045 | 7.0 |
| 2 | Perpendicular @ 4:30 and 7:30 o'clock | 0.065 | 8.5 |
| 2 | Perpendicular @ 4:30 and 7:30 o'clock | 0.090 | 7.5 |

[a]Short-handled version

By reviewing Table I, three results were evident: (1) the location of the slot(s) in the C-shaped rim significantly altered the amount of force required to attach and remove the handle attachment; (2) the width of the slot(s) in the rim also significantly altered the amount of force required to attach and remove the handle attachment; and (3) a combination of both (1) and (2) can be used to tailor the amount of force required to attach and remove the handle attachment. The prototypes with a single slot (each of which was disposed between the base of the C-shaped rim and a diametrical chord perpendicular to the rim's axis of symmetry) produced notable decreases in the amount of force required to attach their respective handle attachments. In the case of the prototypes with two perpendicular-oriented (and collinear) slots at 4:30 and 7:30 o'clock and slot widths of about 0.045 to about 0.090 inch (about 1.1 to about 2.3 mm), the amount of force was reduced by roughly one-quarter to one-half of that required for the unslotted samples, and well within the target range of under 10 lbs of force to install the attachment. Similar results were obtained with the prototypes having two parallel slots at 5:30 and 6:30 o'clock. Additionally, the slotted C-shaped rims retained a suitable gripping force on the spray can valve mounting cup so as to maintain an intimate connection to the can without the fear of the can becoming dislodged from the handle due to accidental bumping of the can or the handle.

At the conclusion of the investigation, it was concluded that the slotted rims with perpendicular-oriented collinear slots at 4:30 and 7:30 o'clock (corresponding to FIG. 11) were capable of generating a high gripping strength comparable to an unslotted rim, while also creating a conformable/deformable, expansion/contraction spring utilizing only the memory properties of the polypropylene copolymer used to form the rim. These rims were also able to produce relatively consistent results when formed to have slot widths over a range of about 0.045 to about 0.090 inch (about 1.1 to about 2.3 mm). The embodiments with two roughly-parallel slots at 5:30 and 6:30 o'clock in the base of C-shaped rim (corresponding to FIG. 13) also appeared to be robust as well as easy to insert and remove. The embodiments with a single slot (the 6-o'clock embodiment corresponds to FIG. 14) also achieved improvements, though not to the degree of the other embodiments. Ultimately, the embodiment corresponding to FIG. 11 is believed to be more amenable to the injection molding process desired to form the housing 12.

Potential modifications to the configuration of the rim 26 and its flange 36 depicted in FIGS. 1 through 10 include a semi-flexible/corrugated compression rib (not shown) located above the flange 36 to form a channel that contacts the top of the valve mounting cup 32 and resiliently applies a downward force on the top of the cup 32, effectively capturing the cup 32 between the rib and the flange 36 of the rim 26. Additional potential modifications to the slotted C-shaped rim 26 include beveling the radially inward edge of the flange 36 to reduce the initial force required to press the rim 26 onto the valve mounting cup 32, or forming a raised circumferential rail at or near the radially inward edge of the flange 36 to help self-locate the rim 26 at the bottom of the valve mounting cup 32 and provide upward pressure to help secure the rim 26 to the cup 32. For example, such a rail may protrude roughly 0.010 to 0.030 inch (about 0.25 to about 0.76 mm) from the lower surface of the flange 36.

In addition to the configuration of the rim 26, the invention illustrated in the Figures has other notable features. For example, the grip 14 and trigger 20 can be seen to have ergonomic contours that conform to the hand and fingers to reduce fatigue between forefinger and thumb, as well as reduce wrist, forearm and shoulder fatigue. The upper end of the trigger 20 has a contoured shape that terminates in a roughly horizontal surface against which a user's index finger can be placed to support and balance the attachment 10 without unintentionally actuating the trigger 20 when carrying the attachment 10. The trigger pivot 22 is shown located within the housing neck 16 and forward of the trigger 20, which in combination with the location of the spring 23 and the length of the trigger 20 is capable of drastically reducing the force required to actuate the valve 31. For example, in experiments with the attachment 10, a conventional valve 31 requiring a force of about 8 lbf (about 36 N) to dispense the contents of a spray was actuated by a force of 4 lbf (about 18 N) or less applied with the trigger 20 (a reduction of about 50% or more), corresponding to a mechanical advantage of about 2:1 or more between the trigger 20 and finger 24. Such a capability is in contrast to existing spray can attachments that may even increase the amount of force required at the trigger to actuate a spray valve. The location of the trigger pivot 22 also minimizes the amount of travel (about one inch (about 2.5 cm) or less) required by the trigger 20 to fully operate the valve 31. FIGS. 3 and 9 depict the pivot 22 as formed by a boss 22A and post 22B on the housing halves 12A and 12B, respectively, that mate when the housing halves 12A and 12B are assembled. The boss 22A and post 22B are each radially supported by four flanges 40 that define a keyway for the trigger arm 21. Each support flange 40 defines an edge 42 that contacts the trigger arm 21 when the trigger 20 is actuated, and ribs are defined on the edges 42. The ribs serve to reduce friction between the trigger arm 21 and the support flanges 40 and reduce the risk or degree of sticking if the interior of the housing 12 becomes fouled, for example, if the cap 18 were to be installed backward on the can 30 and contents of the can 30 were dispensed toward and possibly into the housing 12.

FIGS. 9 and 10 depict another additional feature of the attachment 10 as the ability to assemble the housing 12 with a display card 44 suitable for carrying instructions and other information relating to the handle attachment. The display card 44 is shown as having two tabs 46 that project into the interior of the housing 12 through two slots 48 located on top of the housing neck 16. A first of the tabs 46 is shown as being secured within the housing 12 as a result of mating the boss 22A and post 22B that form the trigger pivot 22, while the second tab 46 is secured between a post 50 and boss 52 that may be used solely for the purpose of securing the second tab 46. The edges 42 of the support flanges 40 are preferably recessed to accommodate the first tab 46 and enable the card 44 and at least its first tab 46 to be completely removed from the housing 12 without binding with the trigger 20. To enable complete and clean removal of the card 44 and its tabs 46, the tabs 46 are shown in FIGS. 9 and 10 to have perforations between their distal edges and openings for receiving the posts and bosses 22A, 22B, 50 and 52. Perforations spaced about 1/32 inch (about 0.8 mm) are believed to provide a desirable compromise between retention and complete removability for the card 44.

While the invention has been described in terms of specific embodiments, it is apparent that other forms could be adopted by one skilled in the art. For example, the physical configuration of the housing 12, cap 18, trigger 20, etc, could differ from that shown, and materials and processes other than those noted could be used. Therefore, the scope of the invention is to be limited only by the following claims.

The invention claimed is:

1. A spray can handle attachment adapted for coupling to a valve mounting cup of a spray can and actuating a push-type dispenser valve of the spray can, the spray can handle attachment comprising:

a housing defining a grip and a cap configured to couple with an outer diameter of the valve mounting cup, the cap having oppositely-disposed first and second ends, the second end having a central opening therein sized to accommodate the valve mounting cup;

an actuation device pivotally mounted to the housing, the actuation device having a trigger portion disposed adjacent the grip and a finger portion disposed within the cap of the housing, the finger portion being adapted for movement within the cap toward the second end of the cap to actuate the push-type dispenser valve of the spray can in response to movement of the trigger portion relative to the grip of the housing; and a C-shaped rim disposed on the cap and defining the second end of the cap, the C-shaped rim having a radially-extending flange that defines the central opening of the cap, an axis of symmetry, a base located on the axis of symmetry, a circumferential gap in the flange that is located on the axis of symmetry diametrically opposite the base and separates two ends of the C-shaped rim, and at least one slot that is defined in the flange and is disposed between the base and a diametrical chord perpendicular to the axis of symmetry, the circumferential gap and the at least one slot extending through the flange of the C-shaped rim, the flange of the C-shaped rim being continuous except for the circumferential gap and the at least one slot;

wherein the at least one slot consists of two slots that are collinear, are disposed on opposite sides of the axis of symmetry of the C-shaped rim, and lie on a nondiametrical chord that is perpendicular to the axis of symmetry, and wherein the flange of the C-shaped rim is continuous except for the circumferential gap and the two slots.

2. A spray can handle attachment adapted for coupling to a valve mounting cup of a spray can and actuating a push-type dispenser valve of the spray can, the spray can handle attachment comprising:

a housing defining a grip and a cap configured to couple with an outer diameter of the valve mounting cup, the cap having oppositely-disposed first and second ends, the second end having a central opening therein sized to accommodate the valve mounting cup;

an actuation device pivotally mounted to the housing, the actuation device having a trigger portion disposed adjacent the grip and a finger portion disposed within the cap of the housing, the finger portion being adapted for movement within the cap toward the second end of the cap to actuate the push-type dispenser valve of the spray can in response to movement of the trigger portion relative to the grip of the housing; and a C-shaped rim disposed on the cap and defining the second end of the cap, the C-shaped rim having a radially-extending flange that defines the central opening of the cap, an axis of symmetry, a base located on the axis of symmetry, a circumferential gap in the flange that is located on the axis of symmetry diametrically opposite the base and separates two ends of the C-shaped rim, and at least one slot that is defined in the flange and is disposed between the base and a diametrical chord perpendicular to the axis of symmetry, the circumferential gap and the at least one slot extending through the flange of the C-shaped rim, and the flange of the C-shaped rim being continuous except for the circumferential gap and the at least one slot;

wherein the at least one slot consists of two parallel slots, the two parallel slots are located on the base of the C-shaped rim and are on opposite sides of the axis of symmetry of the C-shaped rim, and the flange of the C-shaped rim is continuous except for the circumferential gap and the two parallel slots.

3. The spray can handle attachment according to claim 2, wherein each of the two parallel slots is closer to the axis of symmetry of the C-shaped rim than the two ends of the C-shaped rim.

4. The spray can handle attachment according to claim 1, wherein the cap comprises a window sized to permit a spray emitted by the push-type dispenser valve to exit the cap when the cap is coupled to the valve mounting cup.

5. The spray can handle attachment according to claim 1, wherein the housing comprises housing halves, and the actuation device is pivotally mounted between the housing halves.

6. The spray can handle attachment according to claim 5, wherein the housing comprises at least one slot between the housing halves, the spray can handle attachment further comprises a display card external to the housing and having a tab that extends into the housing through the slot of the housing, and the housing comprises means for securing the tab within the housing.

7. The spray can handle attachment according to claim 6, wherein the securing means comprises a pivot about which the actuation device pivots.

8. A spray can handle attachment adapted for coupling to a valve mounting cup of a spray can and actuating a push-type dispenser valve of the spray can, the spray can handle attachment comprising:

a housing defining a grip and a cap configured to couple with an outer diameter of the valve mounting cup;

an actuation device pivotally mounted to the housing, the actuation device having a trigger portion disposed adjacent the grip and a finger portion disposed within the cap of the housing actuating the push-type dispenser valve of the spray can in response to movement of the trigger portion relative to the grip of the housing;

a pivot within the housing and about which the actuation device pivots, flanges surrounding the pivot, and corrugated edges defined on the flanges for reducing friction between the actuation device and the housing; and a C-shaped rim disposed on the cap, the C-shaped rim having an axis of symmetry and defining a central opening sized to accommodate the valve mounting cup, a base located on the axis of symmetry, a circumferential gap located on the axis of symmetry diametrically opposite the base and separating two ends of the C-shaped rim, and at least one slot disposed between the base and a diametrical chord perpendicular to the axis of symmetry.

9. The spray can handle attachment according to claim 1, further comprising a pivot within the housing and about which the actuation device pivots, the pivot being located between the trigger portion and the finger portion of the actuation device.

10. The spray can handle attachment according to claim 1, wherein thenondiametrical chord is located approximately midway between the base of the C-shaped rim and the diametrical chord perpendicular to the axis of symmetry of the C-shaped rim.

11. The spray can handle attachment according to claim 1, wherein base of the C-shaped rim is between the grip of the housing and the circumferential gap of the C-shaped rim.

12. The spray can handle attachment according to claim 11, wherein the circumferential gap of the C-shaped rim is contiguous with a window defined in the cap and sized to permit a spray emitted by the push-type dispenser valve to exit the cap when the cap is coupled to the valve mounting cup.

13. The spray can handle attachment according to claim 1, wherein the actuation device has a mechanical advantage of about 2:1 or more between the trigger portion and the finger portion.

14. A spray can handle attachment adapted for coupling to a valve mounting cup of a spray can and actuating a push-type dispenser valve of the spray can, the spray can handle attachment comprising:

a housing defining a grip, a cap configured to couple with an outer diameter of the valve mounting cup, and a window defined in the cap and sized to permit a spray emitted by the push-type dispenser valve to exit the cap when the cap is coupled to the valve mounting cup, the cap having oppositely-disposed first and second ends, the second end having a central opening therein sized to accommodate the valve mounting cup;

an actuation device pivotally mounted to the housing, the actuation device having a trigger portion disposed adjacent the grip and a finger portion disposed within the cap of the housing, the finger portion being adapted for movement within the cap toward the second end of the cap to actuate the push-type dispenser valve of the spray can in response to movement of the trigger portion relative to the grip of the housing; and a C-shaped rim disposed on the cap and defining the second end of the cap, the C-shaped rim having a radially-inward extending flange that defines the central opening of the cap, an axis of symmetry, a base located on the axis of symmetry, a circumferential gap in the flange that is contiguous with the window of the cap and is located on the axis of symmetry diametrically opposite the base and separates two ends of the C-shaped rim, and at least two slots that are defined in the flange, disposed between the base and a diametrical chord perpendicular to the axis of symmetry, and do not lie on the axis of symmetry of the C-shaped rim, the circumferential gap and the at least two slot extending through the flange of the C-shaped rim, wherein the at least two slots consist of two slots that are collinear, are disposed on opposite sides of the axis of symmetry of the C-shaped rim, and lie on a nondiametrical chord that is perpendicular to the axis of symmetry of the C-shaped rim and located approximately midway between the base of the C-shaped rim and the diametrical chord perpendicular to the axis of symmetry of the C-shaped rim, and the flange of the C-shaped rim is continuous except for the circumferential gap and the two slots.

* * * * *